US010663254B1

(12) United States Patent
Molcho

(10) Patent No.: US 10,663,254 B1
(45) Date of Patent: May 26, 2020

(54) ILLUMINATION MODULE FOR A HANDGUN

(71) Applicant: Haim Refael Molcho, Herzliya (IL)

(72) Inventor: Haim Refael Molcho, Herzliya (IL)

( * ) Notice: Subject to any disclaimer, the term of this patent is extended or adjusted under 35 U.S.C. 154(b) by 0 days.

(21) Appl. No.: 16/438,522

(22) Filed: Jun. 12, 2019

(51) Int. Cl.
*F41G 1/34* (2006.01)
*F41G 1/10* (2006.01)

(52) U.S. Cl.
CPC ..... *F41G 1/345* (2013.01); *F41G 1/10* (2013.01)

(58) Field of Classification Search
CPC . F41G 1/35; F41G 1/34; F41G 11/004; F41G 1/345; F41G 1/00; F41G 1/17; F41G 1/06; F41G 1/16; F41G 1/10
USPC ..... 42/117, 146
See application file for complete search history.

(56) References Cited

U.S. PATENT DOCUMENTS 1,911,770 A * 5/1933 Redfield ..... F41G 1/16 42/137
3,678,590 A * 7/1972 Hayward ..... F41G 1/345 42/132
3,942,256 A * 3/1976 Khaidurov ..... F41G 1/26 42/137
4,945,667 A * 8/1990 Rogalski ..... F41G 1/34 42/114
4,977,676 A * 12/1990 Toupin ..... F41G 1/18 42/138
5,068,969 A * 12/1991 Siebert ..... F41G 1/345 362/110
5,369,888 A * 12/1994 Kay ..... F41G 1/30 356/252
5,467,552 A * 11/1995 Cupp ..... F41G 1/26 42/125
5,735,070 A * 4/1998 Vasquez ..... F41A 9/62 42/1.02
5,887,352 A * 3/1999 Kim ..... F41G 1/01 42/144
5,933,972 A * 8/1999 Springer, Jr. ..... F41G 1/34 42/133
6,327,806 B1 * 12/2001 Paige ..... F41G 1/30 42/113
6,360,469 B1 * 3/2002 Mikuta ..... F41A 17/066 42/70.11
6,490,060 B1 * 12/2002 Tai ..... G02B 5/32 33/333
7,796,329 B2 * 9/2010 Dobschal ..... F41G 1/30 359/1
7,916,290 B2 * 3/2011 Koehler ..... G02B 27/0025 356/247
7,954,273 B1 * 6/2011 Swan ..... F41G 11/004 362/110
8,117,780 B2 * 2/2012 Matthews ..... F41A 33/00 42/114

(Continued)

*Primary Examiner* — Joshua E Freeman
*Assistant Examiner* — Bridget A Cochran
(74) *Attorney, Agent, or Firm* — Alphapatent Associates, Ltd; Daniel J. Swirsky

(57) ABSTRACT

The subject matter discloses an illumination module for a handgun, comprising a body, a mounting interface protruding from the body, and configured to be in physical contact with the handgun slide, a sight, extending from the body, an illumination module configured to emit light towards a front sight of the handgun, a power source electrically coupled to the illumination module, an activation module coupled to the illumination module, maneuver of the activation module activates the illumination module.

10 Claims, 6 Drawing Sheets

(56) References Cited

U.S. PATENT DOCUMENTS 8,561,518 B2 * 10/2013 Teetzel ..... F41G 1/473 235/414
8,997,391 B2 * 4/2015 Rozic ..... F41G 1/02 42/111
9,285,186 B1 * 3/2016 Di Veroli ..... F41G 1/06
9,316,461 B1 * 4/2016 Gwillim, Jr. ..... F41G 1/345
9,453,706 B1 * 9/2016 Crispin ..... F41G 1/06
9,823,044 B1 * 11/2017 Cabrera ..... F41G 1/17
10,126,099 B1 * 11/2018 Hammond ..... F41G 1/30
10,180,306 B2 * 1/2019 Ben Zion ..... F41G 1/01
D849,180 S * 5/2019 Cheng ..... D22/109
10,352,654 B2 * 7/2019 Costet ..... F41G 1/26
2006/0048432 A1 * 3/2006 Staley, III ..... F41G 1/38 42/122
2007/0039226 A1 * 2/2007 Stokes ..... F41C 23/16 42/146
2008/0216379 A1 * 9/2008 Javorsky ..... F41G 1/12 42/115
2009/0113778 A1 * 5/2009 Paterson ..... F41G 1/16 42/90
2010/0083554 A1 * 4/2010 Elpedes ..... F41G 1/14 42/123
2010/0175297 A1 * 7/2010 Speroni ..... F41G 1/35 42/114
2012/0102808 A1 * 5/2012 Matthews ..... F41G 1/30 42/113
2012/0180370 A1 * 7/2012 McKinley ..... F41G 1/02 42/146
2013/0097881 A1 * 4/2013 Profos ..... F41G 1/345 33/263
2013/0283660 A1 * 10/2013 Matthews ..... F41G 1/30 42/113
2014/0000145 A1 * 1/2014 Merritt ..... F41G 11/004 42/114
2015/0040409 A1 * 2/2015 Morrison ..... F41B 5/1492 33/228
2015/0198415 A1 * 7/2015 Campean ..... F41G 1/18 42/137
2015/0267998 A1 * 9/2015 Grace, Jr. ..... F41G 1/345 42/117
2015/0308787 A1 * 10/2015 Cheng ..... F41G 1/34 42/126
2015/0345901 A1 * 12/2015 Cheng ..... F41C 33/08 42/111
2016/0010949 A1 * 1/2016 Teetzel ..... F41G 1/35 42/115
2016/0102943 A1 * 4/2016 Teetzel ..... F41G 1/35 42/113
2016/0305741 A1 * 10/2016 Jeung ..... F41G 1/345
2016/0313089 A1 * 10/2016 Collin ..... F41G 1/30
2017/0205194 A1 * 7/2017 Teetzel ..... F41G 1/01
2018/0104613 A1 * 4/2018 Faecher ..... A63H 33/22
2018/0172399 A1 * 6/2018 Ben Zion ..... F41G 1/345
2018/0372448 A1 * 12/2018 Noskowicz ..... F41G 1/345
2019/0078857 A1 * 3/2019 Vergara ..... H01L 35/32
2019/0107368 A1 * 4/2019 Ben Zion ..... F41G 1/10

* cited by examiner

ILLUMINATION MODULE FOR A HANDGUN

FIELD OF THE INVENTION

The present invention relates to an illumination module that can be mounted to the upper surface of the handgun body.

BACKGROUND OF THE INVENTION

Various techniques and devices have been developed to help a person accurately aim a handgun in order to improve the handgun and its usage. Multiple instruments used to improve handgun usage are sights to improve shooting accuracy, flashlights for illuminate the target in the dark and holster to secure the handgun on the user's body.

There are many type of sights. Iron sights are a type of weapons' sights that have a front sight and a rear sight. The weapon's user aligns both the front sight and the rear sight at the target. Reflex sights comprise an optical device that allows the user to look through a partially reflecting glass element and see an illuminated projection of an aiming point or some other image superimposed on the field of view.

Another device which helps to handgun user is illumination module, such as a flashlight which helps the user to see the target in dark places. There are two options in the prior art to have illumination for handguns. One option is a flashlight that is conceded to the frame of the handgun under the barrel. In this case the shape of the handgun changes and becomes much bigger which disables the user from carrying the handgun in a standard in side holster located in the user's waistline and make the user use outside holster.

The second option is a regular hand flashlight which forces the user to hold the handgun in one hand and a hand flashlight in the second hand which makes it difficult for the user to shoot accurately and limits the user's movements. Sights are usually fixed to weapon and used to assist during the aiming process in which the weapon's user aims the weapons at a target.

SUMMARY OF THE INVENTION

It is an object of the subject matter to disclose illumination module, comprising a body, a mounting interface protruding from the body, and configured to be in physical contact with the handgun, a sight, extending from the body, an illumination unit configured to emit light towards a front sight of the handgun, a power source electrically coupled to the illumination module, an activation module coupled to the illumination module, wherein maneuver of the activation module activates the illumination module.

The illumination module of the subject matter comprises a sight and an illumination unit such as a flashlight. The illumination module is located in the same place as a standard rear sight, on the upper surface of the handgun body, also defined as the slide of the handgun. The flashlight sight does not increase the handgun's frame which helps the user to carry the handgun in a standard holster located in the user's waistline. The illumination module of the subject matter enables its user to pull out the handgun from a standard in side holster located in the user's waistline and hold the handgun with two hands in a dark places when the user need a illumination.

In some cases, the illumination module further comprises multiple illumination units having two different illumination properties. In some cases, the illumination module further comprises a power source housing configured to house the power source. In some cases, the power source housing is located in a rear side of the slide, wherein the power source housing has a front surface configured to be placed on a rear side of the handgun. In some cases, the body comprises a front section and a rear section, said front section is configured to be secured to the upper surface of the handgun and the rear section is configured to be secured to a rear surface of the handgun.

In some cases, the mounting interface protrudes downwards from the front section and configured to be inserted into a niche in a top surface of the handgun, also defined as the handgun's slide. In some cases, the mounting interface protrudes from the rear section and configured to be inserted into a niche in a rear surface of the handgun. In some cases, the front section comprises a bottom wall configured to be secured to the upper surface of the handgun and a frame extending upwards from the bottom wall, wherein the frame forms a volume having the sight. In some cases, the illumination module is located on a front surface of the frame. In some cases, the front section comprises a lateral wall, wherein the lateral wall comprises the activation module and circuitry configured to transfer electrical signals to the illumination module.

It is an object of the subject matter to disclose a rear handgun illumination module, comprising a body, a mounting interface protruding from the body, and configured to be in physical contact with the handgun, a sight, extending from the body, an illumination module configured to emit light towards a front sight of the handgun, a power source electrically coupled to the illumination module, an activation module coupled to the illumination module, wherein maneuver of the activation module activates the illumination module. The body comprises a front section and a rear section, said front section is configured to be secured to the upper surface of the handgun and the rear section is configured to be secured to a rear surface of the handgun. The illumination module also comprises a power source housing configured to house the power source, wherein the power source is located in the rear section. The mounting interface protrudes downwards from the front section. The front section comprises a bottom wall configured to be secured to the upper surface of the handgun and a frame extending upwards from the bottom wall, wherein the frame forms a volume having the sight, and wherein the illumination module is located on a front surface of the frame.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

The following detailed description of embodiments of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts.

DETAILED DESCRIPTION OF THE INVENTION

The subject matter discloses a rear handgun illumination module that mounting on a handgun. The rear handgun sight comprises an illumination module configured to illuminate towards a front side of the handgun and a power source electrically coupled to the illumination module. The subject matter deals with a technical problem in which illumination modules are secured to the front side of the handgun. As handguns are regularly carried in holsters, users have to carry the illumination module separately from the handgun in order to insert the handgun into the holster. However, handgun users, such as civilians, policemen and soldiers, are sometimes required to use the handgun at immediate circumstances such as when chasing criminals, and cannot spend precious time to install the illumination module while running after the criminal. Thus, an illumination module which is an integral part of a rear handgun sight enables using the illumination module in the battle field as well as conveniently mounting the handgun inside the holster. The term handgun disclosed herein refers to a short-barreled handgun that can be held and used with one hand. Common handgun sub-types are revolvers and semi-automatic pistols.

Figure 1:
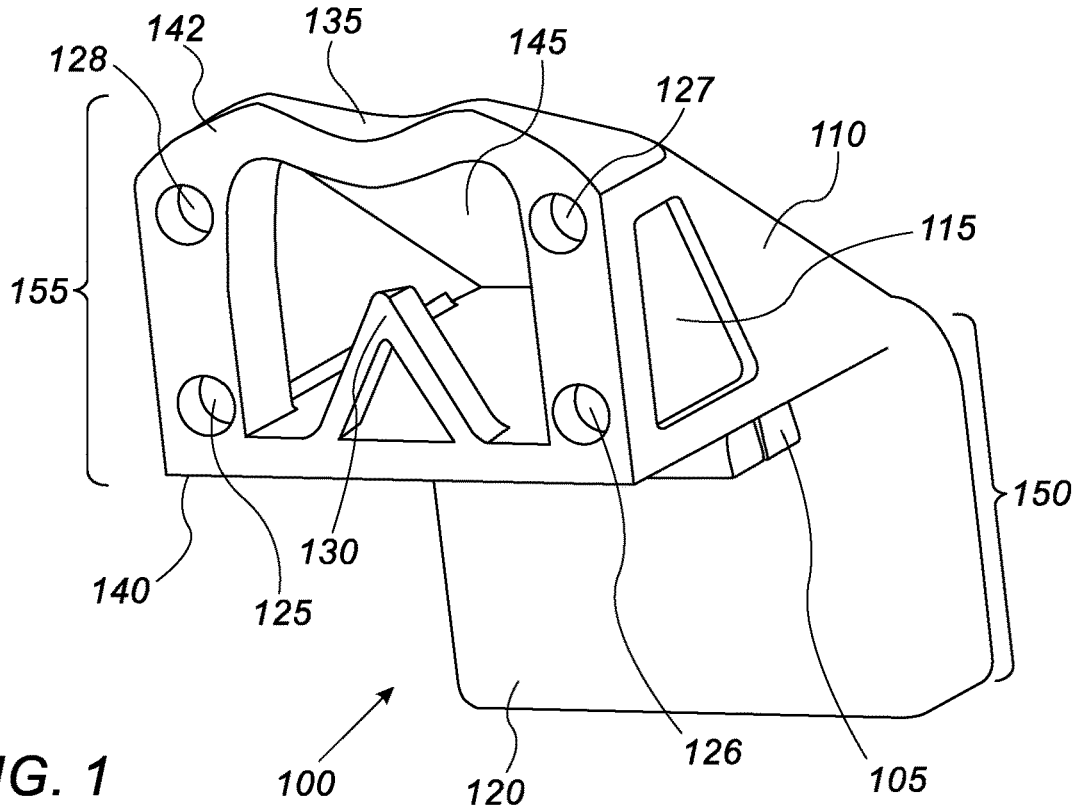
FIG. 1 shows a front view of a rear handgun illumination module, according to exemplary embodiments of the present invention.

FIG. 1 shows a front view of a rear handgun sight, according to exemplary embodiments of the present invention. The rear handgun illumination module 100 is configured to be mounted to an upper-rear part of the handgun. The rear handgun illumination module 100 may be removable from the handgun, for example for repair and upgrade purposes.

The rear handgun illumination module 100 comprises an illumination module having one or more illumination units configured to emit light towards a front end of the handgun. The light may be in a visible light range, may be infra-red, ultra violet light laser illumination and a combination thereof. The rear handgun illumination module 100 also comprises an activation module 115 coupled to the illumination module, such that pressing or otherwise maneuvering the activation module 115 results in light emitted from the illumination module. The rear handgun illumination module 100 also comprises a power source configured to supply power to the illumination module.

In some exemplary cases, the rear handgun illumination module 100 comprises a front section 155 and a rear section 150. The front section 155 comprises the illumination module. In some cases, the front section 155 is mounted on an upper surface of the handgun body, for example on top of the handgun's slide, and the rear section 150 is in physical contact with a rear side of the handgun. The rear handgun illumination module 100 may be of an "L" shape, in which one part of the "L" is defined as the front section 155 and another part of the "L" is defined as the rear section 150.

The rear handgun illumination module 100 also comprises a mounting interface 105 configured to affix the rear handgun illumination module 100 to the handgun's slide. The mounting interface 105 may be located in the bottom side of the front section 155. The illumination module 100 may be secured to the handgun's slide using adhesive materials, screws and another mechanism desired by a person skilled in the art.

The mounting interface 105 may be manufactured from plastic, metal or other rigid materials. The width of the mounting interface 105 may be limited by the width of the front section 155. The rear handgun illumination module 100 may be fixed to the handgun's slide as a result of friction between the handgun and the mounting interface 105.

The rear handgun illumination module 100 also comprises a frame 140, coupled to the upper surface of the front section 155. The frame 140 may be located at a front end of the front section 155. The rear handgun illumination module 100 may be assembled of two components—the first component comprises the mounting interface 105 and the second component comprises the frame 140 and the illumination units.

The frame 140 forms a window 145 enabling the user of the handgun to look through. The window 145 may be a void, or transparent layer, such as transparent glass or plastic material connected to the frame 140. The frame 140 may be connected to a sight 130. The sight 130 may be located in the bottom side of the frame 140. The sight 130 may extend upwards from the bottom of the frame 140. The sight 130 can be fixed with the front sight. The bottom of the frame 140 is close to the tangent surface between the rear handgun illumination module 100 and the handgun. The frame 140 may also define a bridge 135 at the upper part of the frame 140.

The rear handgun illumination module 100 also comprises illumination units 125, 126, 127 and 128. The illumination units 125, 126, 127 and 128 may be located on a front surface 142 of the frame 140. The illumination units 125, 126, 127 and 128 are configured to emit light towards a front sight of the handgun. The emitted light may be constant in amplitude and wavelength for a predefined period of time. In some other cases, the emitted light may change its properties, such as the brightness of light as a result of fluctuations of the illumination units 125, 126, 127 and 128. The luminous power of the light emitted from the illumination units 125, 126, 127 and 128 may be in the range of 200 to 450 lumens, where the lumen is a measure of the total quantity of visible light emitted by an illumination unit per unit of time. The illumination module 100 may comprise one or more illumination units, for example four illumination units 125, 126, 127 and 128 shown herein.

In some cases, the illumination module 100 utilizes a first portion of the illumination units to emit light towards a front sight of the handgun and a second portion of the illumination units to flicker towards the front sight of the handgun. For example, illumination units 125 and 126 may be used to illuminate and illumination units 127 and 128 may be used to flicker. The lighting range of the illumination units 127 and 128 may be in the range of 10-30 meters. Flickering may be defined by frequent change of the emitted illumination, for example between S and 50 changes per second.

The rear handgun illumination module 100 also comprises a lateral wall 110 extending upwards from the top surface 225 of the front section 155. The lateral wall 110 may be substantially perpendicular to the frame 140. The lateral wall 110 may contain the activation module 115 disclosed below and electrical circuitry required to illuminate the illumination units in response to maneuver of the activation module 115.

The illumination module 100 also comprises an activation module 115 configured to enable a user of the handgun to activate the illumination unit. The activation module 115 may be located on an external side surface of the front section 155. The activation module 115 may be used to change the operation mode of one or more of the illumination units from "on" mode to "off" mode and vice versa. The activation module 115 is electrically coupled to the power source and electrically coupled to the illumination unit. When the user of the handgun pushes or otherwise maneuvers the activation module 115, an electrical circle may be closed or opened, thus enabling the rear handgun sight 100 to illuminate or stop illuminating. When the rear handgun sight 100 is at "on" mode of operation, continues push on the activation module 115 may change the illumination mode from continuous light to light fluctuations mode.

Figure 2:
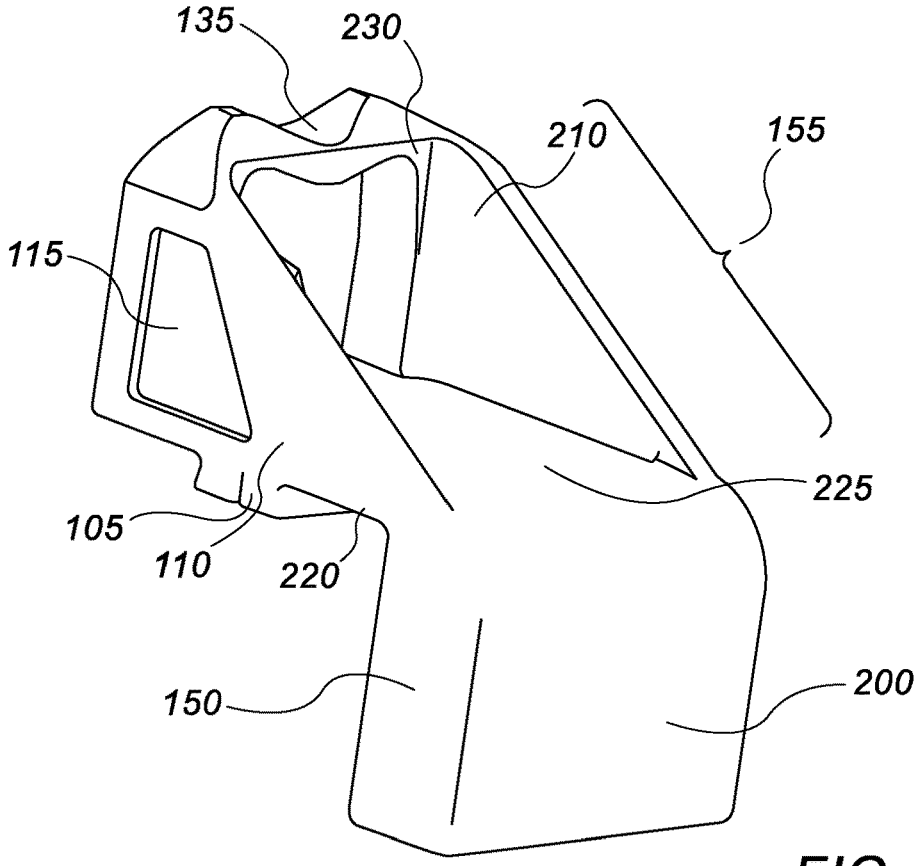
FIG. 2 shows a rear view of a rear handgun illumination module, according to exemplary embodiments of the present invention.

FIG. 2 shows a rear view of a rear handgun illumination module, according to exemplary embodiments of the present invention. The rear view of the rear handgun illumination module 100 shows a top surface 225 of the front section 155. The front section 155 also has a bottom surface 220, configured to match to the upper section of the handgun. The mounting interface 105 may extend downwards from the bottom surface 220, and slide into a niche in the handgun.

The front section 155 also comprises two lateral walls 110 and 210. The two lateral walls 110 and 210 may extend upwards from the top surface 225 of the front section 155. The two lateral walls 110 and 210 may be substantially parallel to each other. The activation module 115 may be located in an external side of one of the two lateral walls 110 and 210. The activation module 115 may be used by the user of the rear handgun illumination module 100 to change an operation mode from "on" to "off", or to activate the illumination units in the illumination module 100. When the user of the rear handgun illumination module 100 pushes or otherwise maneuvers the activation module 115, the illumination module emits light via the illumination units. In some cases, when the rear handgun illumination module 100 is at "on" mode, continuous push on the activation module 115 changes the illumination mode from continuous illumination to fluctuation mode. The activation module 115 may be a button, a switch, a pin, a touch-operated screen and the like.

The illumination module 100 may also comprise a frame 140. The frame 140 is located on the front section 155. The frame 140 may be located on a front edge of the front section 155. The frame 140 may have a square form with two walls being orthogonal to the upper side of the front section 155. The frame 140 has a front surface 142 and the back surface 230. The illumination units 125, 126, 127 and 128 may be located in the frame 140, for example extending from a front surface of the frame 140.

The rear illumination module 100 may also comprise a rear section 150. The upper end of the rear section 150 may be connected to the front section 155. In some exemplary cases, a lower front surface 120 of the rear section is configured to be secured to the rear side of the handgun. The lower front surface 120 may have a flat form, or any other form that matches to the form of the handgun's rear side to which the lower front surface 120 is configured to be secured.

The rear handgun illumination module 100 also comprises a housing 200 of a power source. The power source is configured to store power and provide the power to the illumination units of the rear handgun illumination module 100. The power may be electrical power. The power source may be a battery. The battery may be rechargeable. The housing 200 of the power source may be located in the rear section 150 of the rear handgun sight 100. The housing 200 of the power source may have an interface to the front section 155, said interface is configured to enable wires to pass between the housing 200 and the front section 155, in case the illumination module is located in the front section 155. The size of the housing 200 of the power source may be limited by the size of the rear section 150. The nominal voltage of the power source may be in the range of 1-3.5 volt. The power source is electrically coupled to the activation module 115. When the user pushes the activation module 115 and closes the electrical circle, the power source provides power to the illumination module and allows to it to emit light.

Figure 3:
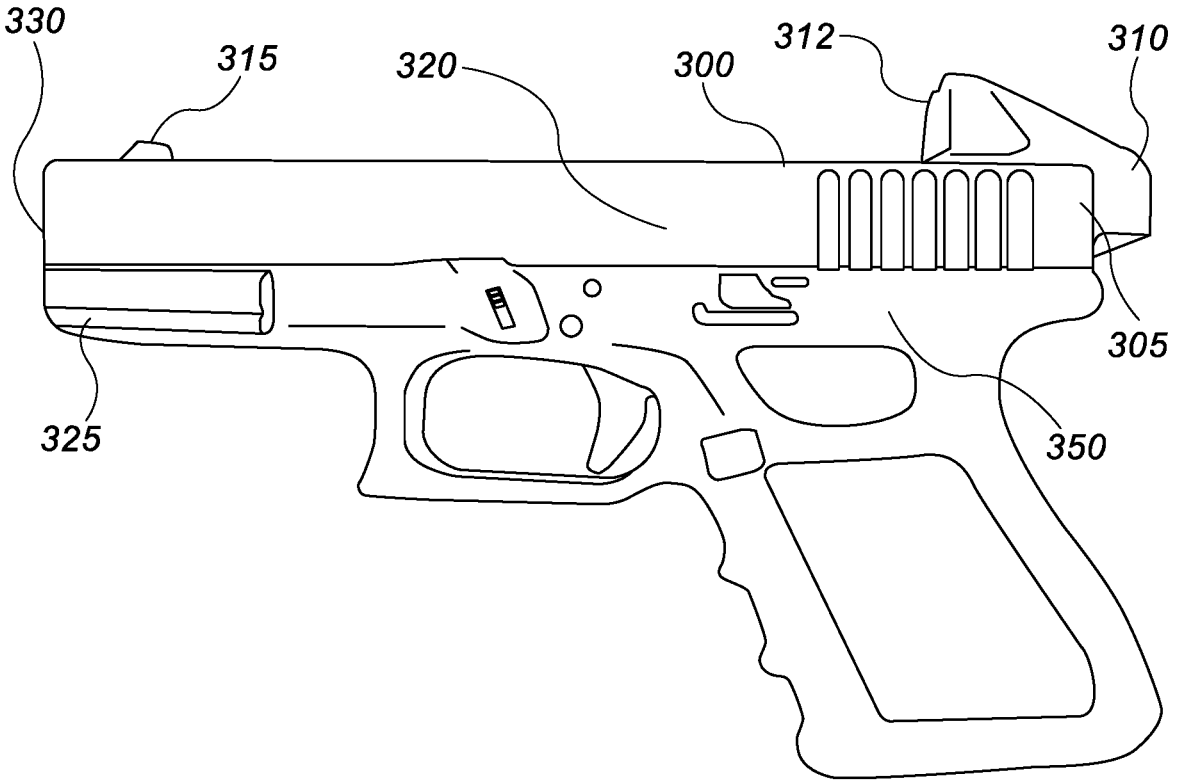
FIG. 3 shows a rear illumination module mounted on a handgun, according to exemplary embodiments of the present invention.

FIG. 3 shows a rear sight mounted on a handgun, according to exemplary embodiments of the present invention. The rear handgun sight comprises a front section 312 and a rear section 310. The front side of the rear handgun sight is defined as a part which is closer to the handgun barrel outlet 330 from which the projectiles leave the handgun. The front section 312 is configured to be mounted on a front surface 300 of the handgun. The rear section 310 is configured to be mounted on a rear surface 305 of the handgun. The rear sight may be mounted on the handgun via the mounting interface affixed into a niche or mechanical track located in an upper section 320 of the gun.

Figure 4:
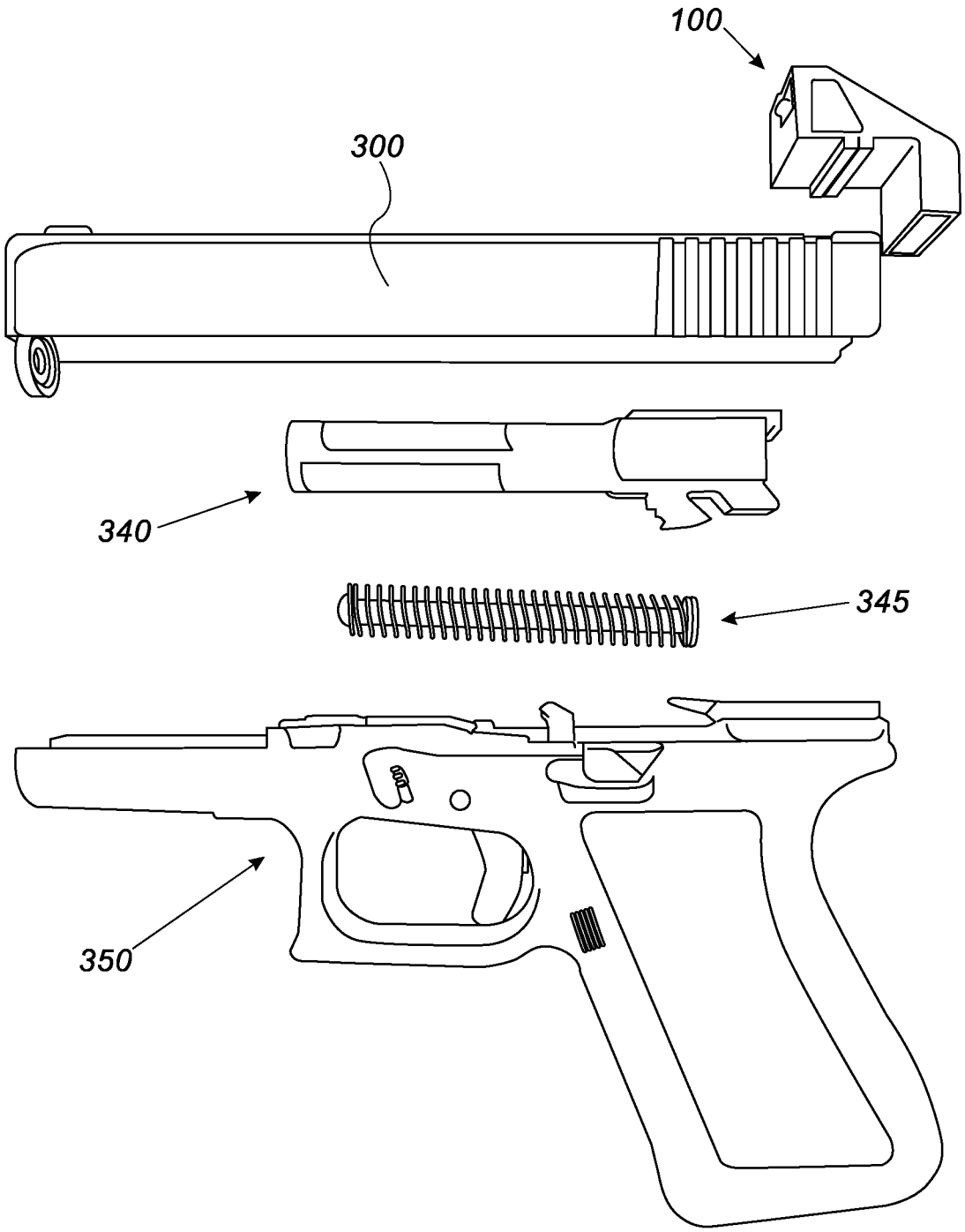
FIG. 4 shows a disassembled handgun, according to exemplary embodiments of the subject matter.

FIG. 4 shows a disassembled handgun, according to exemplary embodiments of the subject matter. The handgun comprises a frame, which forms the body of the handgun. Above the frame 350, there is a slide 300, which is movable after every projectile is shot. The slide 300 comprises a mechanism, such as a track, to secure the illumination module 100 of the claimed subject matter. The slide 300 stores the barrel 340 and the barrel spring assembly 345. The subject matter also discloses a handgun comprising the illumination module disclosed above. In this embodiment, the illumination module is not removable from the handgun, and the frame of the illumination module is made of a single mold as the slide 300 of the handgun.

Figure 5:
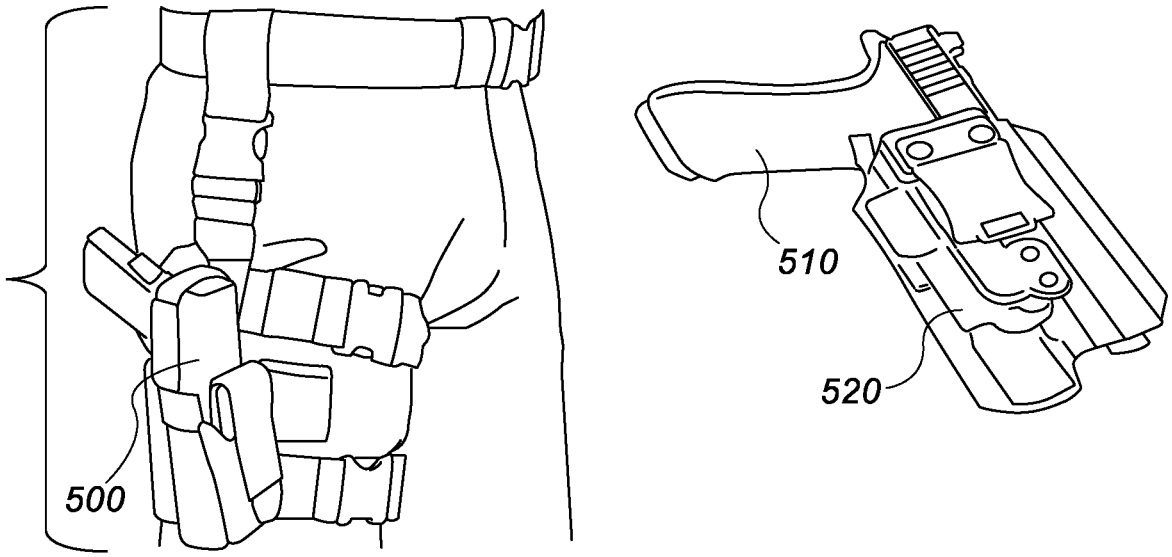
FIG. 5 shows a holster 500 and a handgun, having a prior art flashlight illumination module assembled to the handgun's frame 510.

FIG. 5 shows a holster 500 and a handgun, having a prior art flashlight illumination module assembled to the handgun's frame 510. The holster 500 is located on the person's waistline. The handgun is equipped with a flashlight 520 secured to the handgun's frame 520. The flashlight 520 makes it impossible to insert the handgun with the flashlight to the holster 500.

Figure 6:
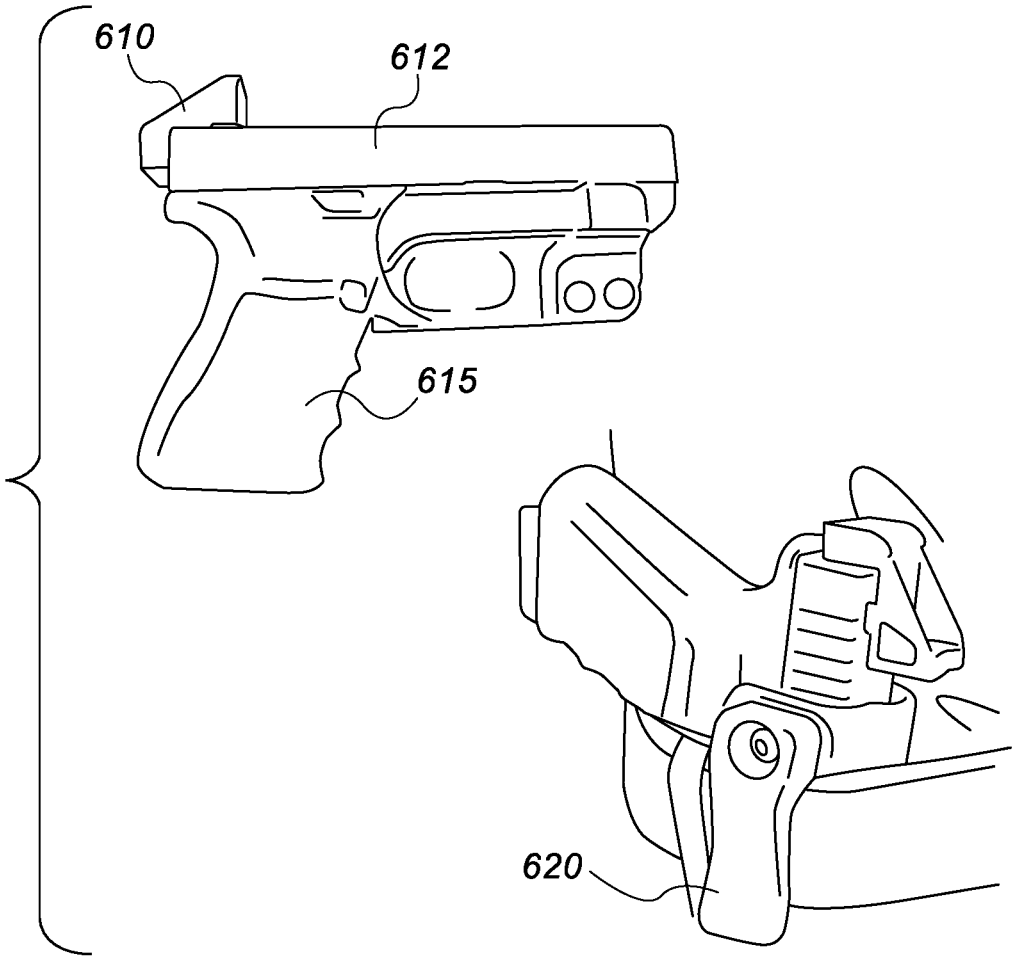
FIG. 6 shows a handgun equipped with an illumination module secured to the upper and rear section of the handgun, according to exemplary embodiments of the subject matter; and, FIG. 7 shows a handgun equipped with an illumination module secured to the upper and rear section of the handgun inserted into a standard holster, according to exemplary embodiments of the subject matter.

FIG. 6 shows a handgun equipped with an illumination module secured to the upper and rear section of the handgun, according to exemplary embodiments of the subject matter. The illumination module 610 is secured to the upper and upper section of the handgun 615, at the rear side of the slide 612. Securing the illumination module 610 at the rear side of the slide 612 enables inserting the handgun into the holster 620, as the rear side of the handgun 615 is left outside the holster 620. This way, the handgun's frame is not extended and the handgun is easily inserted into its holster 620.

Figure 7:
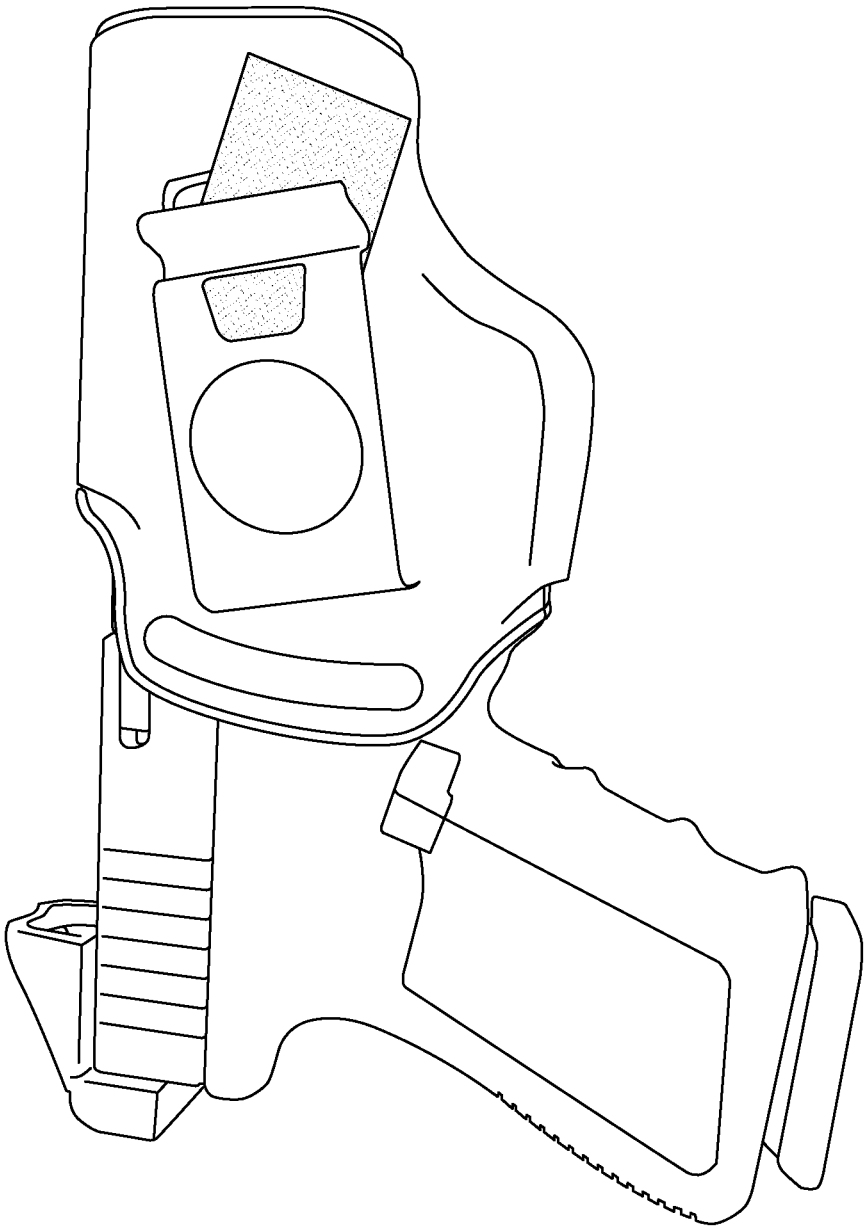

FIG. 7 shows a handgun equipped with an illumination module secured to the upper and rear section of the handgun inserted into a standard holster, according to exemplary embodiments of the subject matter.

While the disclosure has been described with reference to exemplary embodiments, it will be understood by those skilled in the art that various changes may be made, and equivalents may be substituted for elements thereof without departing from the scope of the invention. Besides, many modifications may be made to adapt a particular situation or material to the teachings without departing from the essential scope thereof. Therefore, it is intended that the disclosed subject matter not be limited to the particular embodiment disclosed as the best mode contemplated for carrying out this invention, but only by the claims that follow.

The invention claimed is:

1. An illumination module for a handgun, comprising: a body; a mounting interface protruding from the body, and configured to be in physical contact with a rear part of an upper surface of the handgun; a sight, extending from the body perpendicular to the upper surface, wherein the sight is mounted to the body at a distance between the rear part and a front sight of the handgun; an illumination unit configured to emit light towards the front sight of the handgun, wherein the illumination unit is attached to the body and located laterally adjacent to the sight; a power source electrically coupled to the illumination module; and an activation module coupled to the illumination module, wherein maneuver of the activation module activates the illumination module.

2. The illumination module of claim 1, wherein the illumination module further comprises multiple illumination units having two different illumination properties.

3. The illumination module of claim 1, further comprises a power source housing configured to house the power source.

4. The illumination module of claim 3, wherein the power source housing is located in a rear side of the body, wherein the power source housing has a front surface configured to be placed on a rear side of the handgun.

5. The illumination module of claim 1, wherein the body comprises a front section and a rear section, said from section is configured to be secured to the upper surface of the handgun and the rear section is configured to be secured to a rear surface of the handgun.

6. The illumination module of claim 5, wherein the mounting interface protrudes downwards from the front section and configured to be inserted into a niche in a top surface of the handgun.

7. The illumination module of claim 5, wherein the front section comprises a bottom wall configured to be secured to the upper surface of the handgun and a frame extending upwards from the bottom wall, wherein the frame forms a volume having the sight.

8. The illumination module of claim 7, wherein the illumination unit is located on a front surface of the frame.

9. The illumination module of claim 5, wherein the front section comprises a lateral wall, wherein the lateral wall comprises the activation module and circuitry configured to transfer electrical signals to the illumination module.

10. The illumination module of claim 1, further comprising:

a power source housing configured to house the power source, the body comprises a front section and a rear section, said front section is configured to be secured to the upper surface of the handgun and the rear section is configured to be secured to a rear surface of the handgun;

wherein the power source is located in the rear section;

wherein the mounting interface protrudes downwards from the front section;

wherein the front section comprises a bottom wall configured to be secured to the upper surface of the handgun and a frame extending upwards from the bottom wall, wherein the frame forms a volume having the sight; and wherein the illumination unit is located on a front surface of the frame.

* * * * *